US009279255B2

(12) United States Patent
Bryson et al.

(10) Patent No.: US 9,279,255 B2
(45) Date of Patent: Mar. 8, 2016

(54) LIGHT WEIGHT SHINGLE

(71) Applicant: BUILDING MATERIALS INVESTMENT CORPORATION, Wilmington, DE (US)

(72) Inventors: Michael L. Bryson, Independence, MO (US); Casimir Paul Weaver, Northport, AL (US); Daniel E. Boss, Wilmington, DE (US); Matti Kiik, Richardson, TX (US)

(73) Assignee: BUILDING MATERIALS INVESTMENT CORPORATION, Wilmington, DE (US)

( * ) Notice: Subject to any disclaimer, the term of this patent is extended or adjusted under 35 U.S.C. 154(b) by 0 days.

(21) Appl. No.: 14/206,484

(22) Filed: Mar. 12, 2014

(65) Prior Publication Data

US 2014/0260078 A1 Sep. 18, 2014

Related U.S. Application Data

(60) Provisional application No. 61/784,071, filed on Mar. 14, 2013.

(51) Int. Cl.
*E04D 1/22* (2006.01)
*E04D 1/26* (2006.01)

(52) U.S. Cl.
CPC .. *E04D 1/26* (2013.01); *E04D 1/22* (2013.01); *Y10T 428/24405* (2015.01); *Y10T 428/24421* (2015.01)

(58) Field of Classification Search
CPC ..... E04D 1/16; E04D 1/22; E04D 1/26; E04D 1/265; E04D 1/28; Y10T 428/2443
See application file for complete search history.

(56) References Cited

U.S. PATENT DOCUMENTS 1,913,667 A * 6/1933 Harshberger ..... 428/143
2,493,198 A * 1/1950 Kelley, Jr. ..... C04B 20/068 425/DIG. 101
2,676,892 A * 4/1954 McLaughlin ..... 106/681
2,708,172 A * 5/1955 Robson et al. ..... 428/427
3,365,315 A * 1/1968 Beck et al. ..... 501/33
3,509,010 A * 4/1970 Metzger ..... B28B 23/0087 156/242
3,608,261 A * 9/1971 French et al. ..... 52/316
3,763,609 A * 10/1973 Probst ..... 52/105
3,848,384 A * 11/1974 Eaton et al. ..... 52/420

(Continued)

FOREIGN PATENT DOCUMENTS

EP 0173553 B1 3/1986
FR 2136862 A1 * 12/1972 ..... B32B 18/00

(Continued)

OTHER PUBLICATIONS

Lightweight aggregate systems; http://www.metso.com/miningandconstruction/mm_pyro.nsf/WebWID/WTB-041116-2256F-22290 (2014).

*Primary Examiner* — Robert Canfield
(74) *Attorney, Agent, or Firm* — Baker & McKenzie LLP

(57) ABSTRACT

The present disclosure relates, according to some embodiments, to articles, systems, and methods for roofing a structure including, for example, layered shingles comprising a plurality of layers. A layered shingle may comprise, in some embodiments, an upper layer and a backing layer comprising a low density aggregate, wherein the backing layer is fixed to the substrate-facing surface of the upper layer.

9 Claims, 3 Drawing Sheets

(56) References Cited

U.S. PATENT DOCUMENTS

| | | | | | |
|---|---|---|---|---|---|
| 4,044,520 | A | * | 8/1977 | Barrows | 52/309.12 |
| 4,188,763 | A | * | 2/1980 | Thiis-Evensen | 52/557 |
| 4,206,267 | A | * | 6/1980 | Jungbluth | E04B 7/107 428/138 |
| 4,288,959 | A | * | 9/1981 | Murdock | 52/518 |
| 4,301,633 | A | * | 11/1981 | Neumann | 52/309.4 |
| 4,506,483 | A | * | 3/1985 | Phalen, Jr. | 52/408 |
| 4,634,622 | A | * | 1/1987 | Jenkins et al. | 428/143 |
| 4,717,614 | A | * | 1/1988 | Bondoc et al. | 428/143 |
| 4,794,027 | A | * | 12/1988 | Hering | B29C 37/0082 156/307.7 |
| 5,232,530 | A | * | 8/1993 | Malmquist et al. | 156/78 |
| 5,290,355 | A | * | 3/1994 | Jakel | 106/675 |
| 5,369,929 | A | * | 12/1994 | Weaver et al. | 52/557 |
| 5,465,547 | A | * | 11/1995 | Jakel | E04D 1/04 106/608 |
| 5,502,940 | A | * | 4/1996 | Fifield | 52/309.12 |
| 5,743,059 | A | * | 4/1998 | Fifield | 52/519 |
| 5,813,176 | A | * | 9/1998 | Tzeng et al. | 52/198 |
| 6,378,259 | B1 | * | 4/2002 | Carlson | 52/408 |
| 8,017,531 | B2 | * | 9/2011 | Ahluwalia et al. | 442/136 |
| 8,438,812 | B2 | * | 5/2013 | King et al. | 52/554 |
| 8,511,030 | B2 | * | 8/2013 | Wilson et al. | 52/519 |
| 2003/0046891 | A1 | * | 3/2003 | Colada et al. | 52/518 |
| 2008/0086970 | A1 | | 4/2008 | Ten et al. | |
| 2010/0055399 | A1 | * | 3/2010 | Rosko et al. | 428/148 |
| 2012/0258282 | A1 | | 10/2012 | Hammond et al. | |
| 2012/0305171 | A1 | | 12/2012 | Hammond et al. | |
| 2014/0102031 | A1 | * | 4/2014 | Belt et al. | 52/551 |
| 2015/0240494 | A1 | * | 8/2015 | Kiik | E04D 1/12 428/195.1 |

FOREIGN PATENT DOCUMENTS

| | | | | | |
|---|---|---|---|---|---|
| FR | 2136862 | B1 | * | 5/1973 | B32B 18/00 |
| GB | 768447 | A | * | 2/1957 | E04F 15/08 |
| GB | 1496197 | A | * | 12/1977 | D06N 5/00 |
| JP | 59088383 | A | * | 5/1984 | |
| WO | 8901918 | | | 3/1989 | |

* cited by examiner

LIGHT WEIGHT SHINGLE

CROSS-REFERENCE TO RELATED APPLICATIONS

This application claims priority to U.S. Provisional Application No. 61/784,071 filed Mar. 14, 2013, the contents of which are hereby incorporated in their entirety by reference.

FIELD OF THE DISCLOSURE

The present disclosure relates, in some embodiments, to articles, systems, and methods of making a light weight shingle applicable in roofing systems and other building or structural designs, and a method of making the light weight shingle thereof.

BACKGROUND OF THE DISCLOSURE

Shingles are commonly used components in roofing systems and other building or structural designs. Many benefits derive from shingles with lighter weights, but shingles with reduced weight often lose aesthetical desirability from having reduced profile thicknesses. One concern in developing shingles is balancing the weight reduction of the shingle with the desirability of a substantial profile thickness. Some attempted solutions use low density fillers in the asphalt coating, foaming of the asphalt, low density glass, and other options. However, these are attended by undesirable processing and/or performance properties.

SUMMARY

Accordingly, a need exists for an improved shingle that is light weight but maintains substantial profile thickness. The present disclosure relates, in some embodiments, to articles, systems, and methods of making a light weight shingle for roofing systems and other building or structural designs, and a method of making the light weight shingle thereof.

The present disclosure relates, according to some embodiments, to articles, systems, and methods for roofing a structure including, for example, layered shingles comprising a plurality of layers. A layered shingle may comprise, in some embodiments, an upper layer and a backing layer comprising a low density aggregate, wherein the backing layer may be fixed to the substrate-facing surface of the upper layer. In some embodiments, an upper layer may comprise a headlap and an upper buttlap, wherein the buttlap may comprise one or more tabs interspersed with inter-tab spacings. In some embodiments, a low density aggregate may comprise expanded clay. In some embodiments, a low density aggregate may comprise material selected from the group consisting of expanded clay perlite, polymeric expanded beads, microspheres, recycled asphalt shingles, expanded graphite, granulated polymers, foamed glass, and combinations thereof. In some embodiments, a layered shingle may be a light weight shingle of substantial thickness.

The present disclosure relates, in some embodiments, to roofing systems for cladding a structure comprising a substrate. For example, a roofing system may comprise a plurality of layered shingles and/or an underlayment. A roofing system may partially, substantially, or completely cover a substrate with at least one layered shingle according to the present disclosure.

According to another aspect, the present disclosure relates, in some embodiments, to methods of making and using a layered shingle. For example, a method of making a layered shingle may comprise forming an upper layer and forming a backing layer comprising a low density aggregate. A method for cladding a structure comprising a substrate may comprise, for example, securing (e.g., nailing, screwing, and/or adhering) a plurality of layered shingles to the substrate.

BRIEF DESCRIPTION OF THE DRAWINGS

Some embodiments of the disclosure may be understood by referring, in part, to the present disclosure and the accompanying drawings, wherein.

DETAILED DESCRIPTION

The present disclosure relates, in some embodiments, to a layered shingle for roofing systems and other building or structural designs, and a method of making the light weight shingle thereof. A layered shingle, according to some embodiments, may have a thickness comparable to shingles made without following the present disclosure. Shingles with substantial thickness may advantageously be deemed more aesthetically pleasing. Shingles of lighter weights may facilitate greater ease in transportation and/or installation.

Articles

The present disclosure relates, in some embodiments, to articles (e.g., shingles) comprising a plurality of layers. A shingle may include, for example, an upper layer and a backer. Each layer may have any desired shape and composition. According to some embodiments a backer layer may comprise an upper surface and a substrate-facing surface. A backer layer may comprise a low-density aggregate. In some embodiments, substantially all of a backer layer's composition may be low-density aggregate. A backer layer may comprise low-density aggregate applied to a surface (e.g., a substrate facing surface) of another material, in some embodiments. A low-density shingle may comprise, according to some embodiments, an upper layer comprising a low density aggregate and/or a backer layer comprising low density aggregate.

According to some embodiments, a shingle comprising a low-density aggregate (e.g., expanded clay) backer may be thicker (e.g., ~2% to about ~20% thicker) than a shingle having the same or substantially the same weight and having a backer comprising sand and/or fines. A shingle comprising a low-density aggregate (e.g., expanded clay) backer may be lighter (e.g., ~2% to about ~20% lighter) than a shingle having the same or substantially the same thickness and having a backer comprising sand and/or fines. In some embodiments, a backer layer comprising a low-density aggregate (e.g., expanded clay) may be thicker (e.g., ~2% to about ~20% thicker) than a backer layer having the same or substantially the same weight and comprising sand and/or fines. A backer layer comprising a low-density aggregate (e.g., expanded clay) may be lighter (e.g., ~2% to about ~20% lighter) than a backer layer having the same or substantially the same thickness and comprising sand and/or fines.

Figure 1:
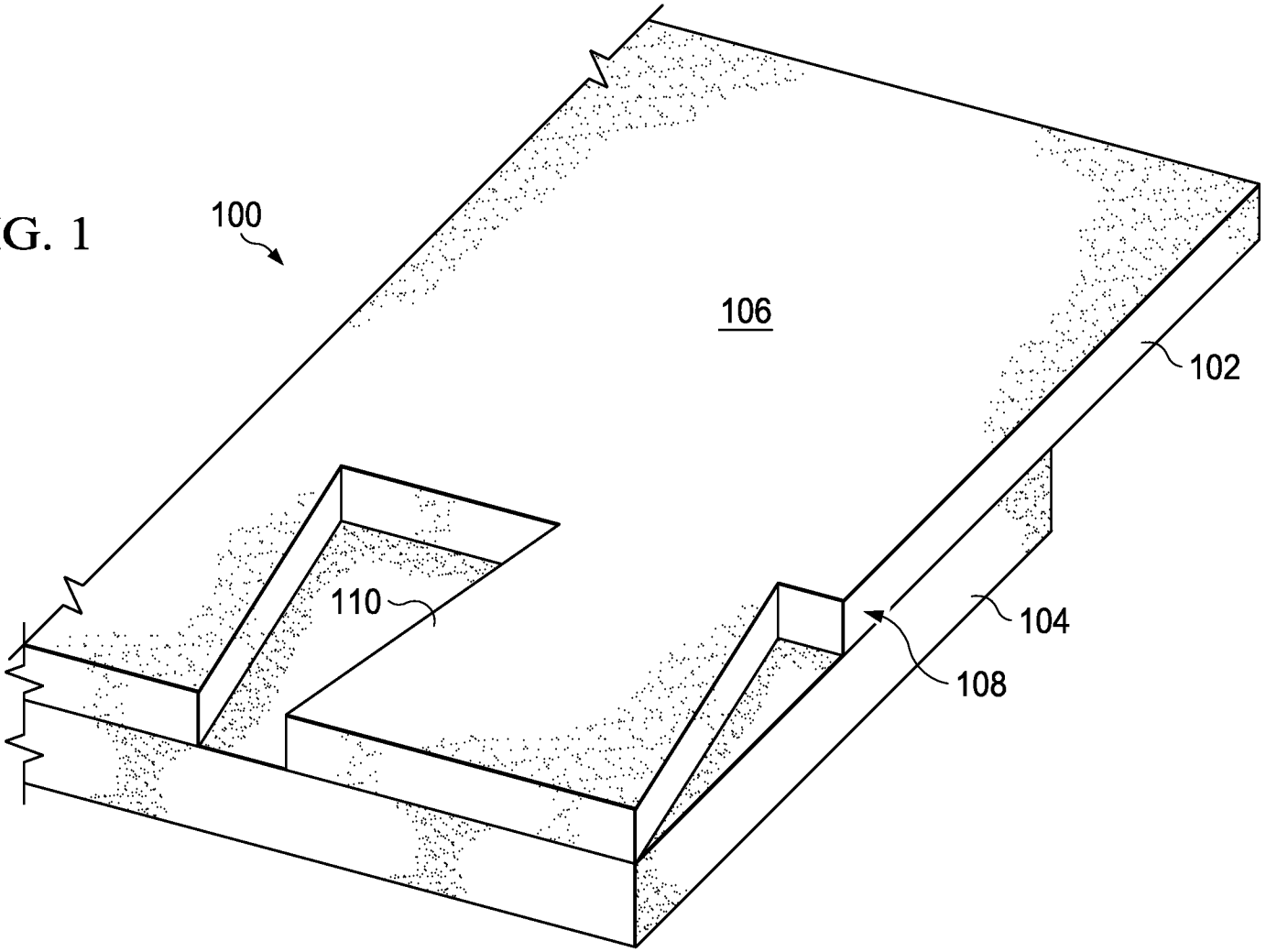
FIG. 1 is an isometric view illustrating a layered shingle according to a specific example embodiment of the present disclosure.

FIG. 1 is an isometric view illustrating a specific example embodiment of a shingle according to the present disclosure.

Figure 2:
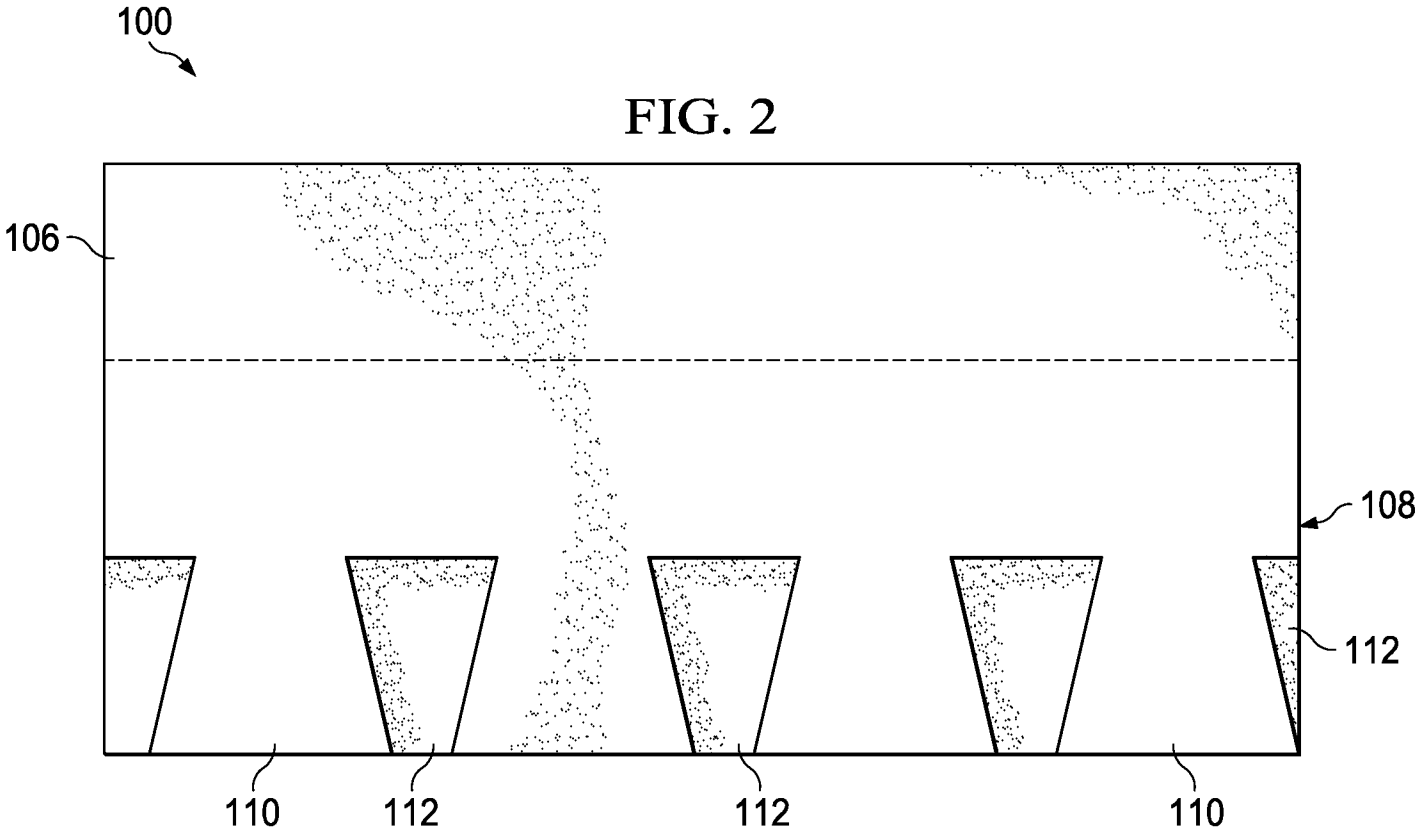
FIG. 2 is a front elevational view illustrating a layered shingle according to a specific example embodiment of the present disclosure.
Figure 3:
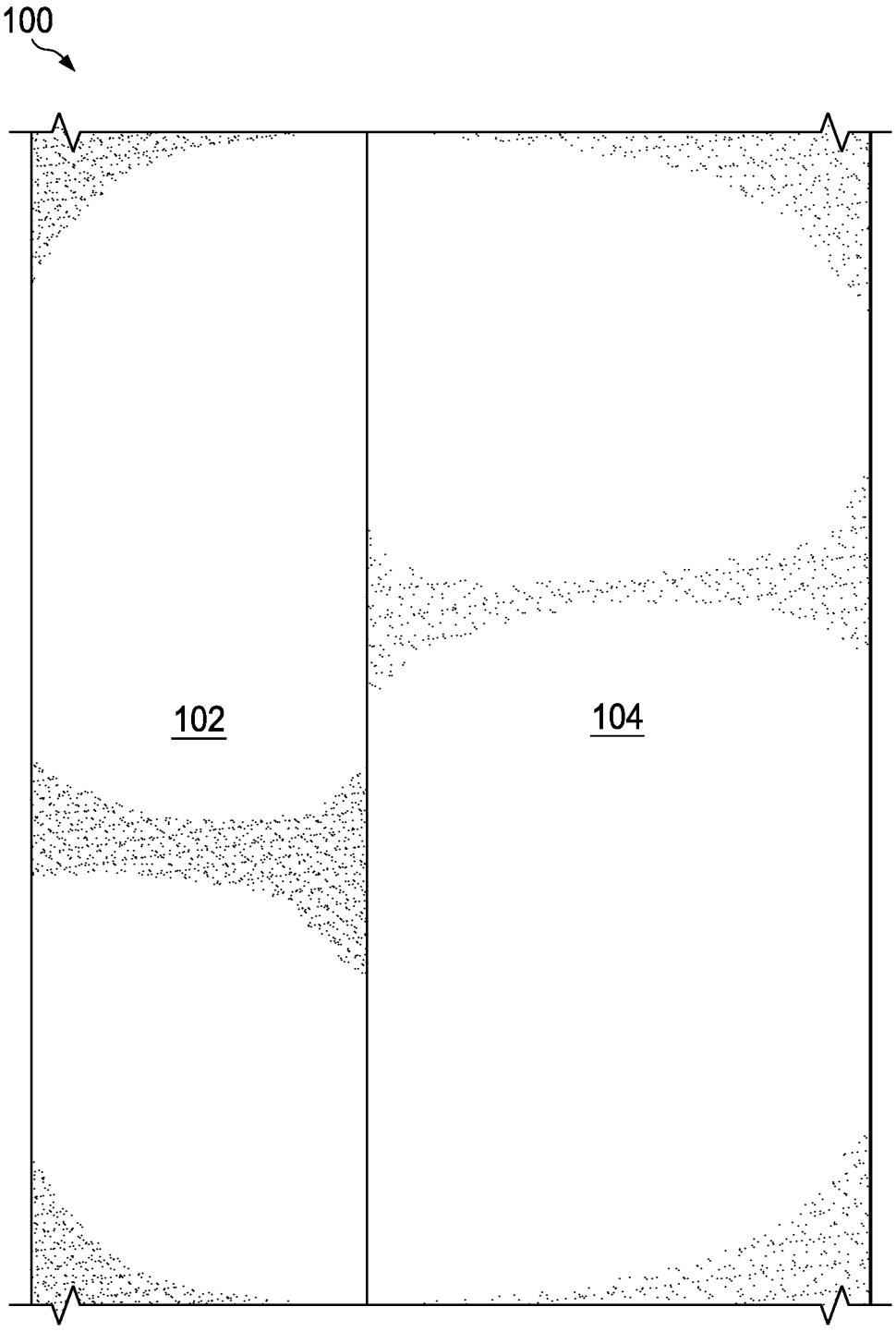
FIG. 3 is a cross-sectional view illustrating a layered shingle according to a specific example embodiment of the present disclosure.

FIG. 2 is a front elevational view illustrating a specific example embodiment of the present disclosure. FIG. 3 is a cross-sectional view illustrating a specific example embodiment of the present disclosure.

Shingle 100 may have upper layer 102 and backing layer 104, wherein the upper layer 102 may be positioned on backing layer 104. Upper layer 102 may comprise headlap 106 and a buttlap 108 that includes at least one tab 110 extending from headlap 106. As seen in FIG. 1 and FIG. 3, backing layer 104 may be thicker than upper layer 102. Backer 104 may have any shape desired. As shown, backer 104 is smaller than upper layer 102.

FIG. 2 illustrates shingle 100 with four tabs 110. FIG. 2 illustrates an exemplary shingle 100 with four tabs 110. In some embodiments tab 110 may have a trapezoidal or dragontooth shape. As shown, tabs 110 may be interspersed from one another by spaces 112. Spaces 112 may have any desired size or shape (e.g., to suit aesthetical or functional goals).

One of ordinary skill in the art would appreciate that upper layer 102 may not be limited to one material or one layer only. Instead, the upper layer may comprise multiple layers. The upper layer may comprise, for example, an asphalt layer, a lamination layer, a paint layer, and a sand or fines layer.

According to some embodiments, a backing layer may comprise any desired low density material. For example, backing layer 104 of shingle 100 may comprise expanded clay. In some embodiments, backing layer 104 of shingle 100 may comprise expanded clay and have a density that is about 80% (or less) of the density of a backer comprising sand and/or granule/rock fines. In some exemplary embodiments, backing layer 104 of shingle 100 may comprise expanded clay, perlite, polymeric expanded beads, microspheres, recycled asphalt shingles, expanded graphite, granulated polymers, and foamed glass. One of ordinary skill in the art would appreciate that other materials may also be used in backing layer 104 without departing from the spirit or scope of the present disclosures. In some embodiments, backing layer 104 may comprise about 10% (wt/wt) expanded clay to about 90% (wt/wt) expanded clay (e.g., about 10% or more, about 20% or more, about 30% or more, about 40% or more). The balance of the composition may include other materials.

In some embodiments of the present disclosure, shingle 100 may be a light weight shingle. In some embodiments, shingle 100 may weigh about ¼ lb or less, about ½ lb or less, about 1 lb or less, about 1½ lb or less, about 2 lb or less, about 2.5 lb or less, about 3 lb or less, or more than about 3 lb.

In some embodiments of the present disclosure, shingle 100 may be a shingle of substantial thickness. For example, a low-density shingle may have the same thickness as a corresponding shingle made with a backer comprising sand or fines, but with reduced weight. In some embodiments, shingle 100 may have a thickness of about ¼" or less, about ½" or less, about ¾" or less, about 1" or less, about 1¼" or less, about 1½" or less, about 1¾" or less, about 2" or less, or more than about 2"

In some embodiments of the present disclosure, shingle 100 may be a laminated shingle, strip shingle, ridge and hip cap sheet, cover on ventilation products, commercial asphaltic roofing sheet, or other roofing or building or structural product.

Systems

Another aspect of the present disclosure relates to roofing systems comprising shingles 100 of the present disclosure. A roofing system may comprise, for example, a plurality of shingles 100, fasteners to secure the layered shingles 100 to a substrate, and/or an underlayment (e.g., felt, glass, fiber, nylon). In some embodiments, the roofing system may be configured such that 100% of a substrate (roof deck) is covered. This may be achieved, for example, by arranging each shingle 100 such that it overlaps at least a portion of another shingle immediately below it. Systems of the present disclosure may be configured and arranged for use on any type of roof decking and at any pitch, slope, or angle.

Methods

Another aspect of the present disclosure relates to methods of making and using shingles 100 of the present disclosure. In some embodiments, the method may comprise forming layer 102 including one or more upper tabs 110, forming backing layer 104, and/or joining upper layer 102 and backing layer 104.

Forming upper layer 102 may include, for example, cutting out a headlap/buttlap design from the desired upper layer materials (e.g., asphalt, fiberglass, sands, fines, slate cement, etc.) Upper layer 102 may be formed from one or more layers. For example, the upper layer may be formed with an asphalt layer, a lamination layer, and a paint layer. In some embodiments, the upper layer may be formed (e.g., pressed, stamped, molded) into a desired three-dimensional shape or texture.

Forming backing layer 104 may include, for example, cutting out a headlap/buttlap design from expanded clay or other low density aggregates (e.g., perlite, polymeric expanded beads, microspheres, recycled asphalt shingles, expanded graphite, granulated polymers, foamed glass, etc.) In some embodiments, the backing layer may be formed (e.g., pressed, stamped, molded) into a desired three-dimensional shape or texture.

In some embodiments of the present disclosure, a method may be applied to laminated shingles, strip shingles, ridge and hip cap sheets, covers on ventilation products, commercial asphaltic roofing sheets, or other roofing or building or structural products.

As will be understood by those skilled in the art who have the benefit of the instant disclosure, other equivalent or alternative systems, articles, materials, and methods for roofing a structure including can be envisioned without departing from the description contained herein. Accordingly, the manner of carrying out the disclosure as shown and described is to be construed as illustrative only.

Persons skilled in the art having the benefit of the present disclosure may make various changes in the shape, size, number, and/or arrangement of parts without departing from the scope of the disclosure. For example, the position and number of low-density shingles in a roofing system may be varied. In some embodiments, low-density shingles may be interchangeable with each other and/or with low-density shingles. Interchangeability may allow roof cladding to be custom adjusted (e.g., according to roof structure, exposure, aesthetics, user preference). In addition, the size of a low-density article and/or system may be scaled up or down to suit the needs and/or desires of a user. Some embodiments of the disclosure are not limited to the scale, shape, and/or sizes found in the drawings. To the extent desired and/or required, appropriate safety measures may be taken in the practice of embodiments of the disclosure. For example, if desired safety equipment may be used to protect users from potentially sharp metal edges that may be present in some embodiments. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated.

Persons skilled in the art may make various changes in methods of preparing and using a system, article, and/or material of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/−about 10%, depicted value +/−about 50%, depicted value +/−about 100%) and/or a range endpoint. With respect to the former, a value of 50 depicted in an example, table, and/or drawing may form the basis of a range of, for example, about 45 to about 55, about 25 to about 100, and/or about 0 to about 100.

All or a portion of a hybrid article and/or system for cladding a structure may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

What is claimed is:

1. A layered shingle for cladding a structure comprising a substrate, the layered shingle comprising:

an upper layer comprising a substrate-facing surface, the upper layer selected from an asphalt layer, a lamination layer, a paint layer, and a sand or fines layer; and a backing layer comprising between about 40% to about 90% by weight of expanded clay, wherein the backing layer is fixed to the substrate-facing surface of the upper layer, and wherein the upper layer comprises an upper headlap and an upper buttlap, and wherein the upper buttlap comprises two or more tabs interspersed with inter-tab spacings.

2. A layered shingle according to claim 1, wherein the backing layer further comprises a low density aggregate that is selected from the group consisting of: perlite, polymeric expanded beads, microspheres, expanded graphite, granulated polymers, foamed glass, or combinations thereof.

3. A layered shingle according to claim 1, wherein the layered shingle is ~2% to 20% lighter in weight than a corresponding shingle having substantially the same thickness except having a backer comprising sand and/or granule/rock fines.

4. A roofing system for cladding a structure comprising a substrate and an underlayment affixed thereon, the roofing system comprising:

at least one layered shingle comprising:

an upper layer comprising a substrate-facing surface, the upper layer selected from an asphalt layer, a lamination layer, and a paint layer; and a backing layer comprising between about 40% to about 90% by weight of expanded clay, wherein the backing layer is fixed to the substrate-facing surface of the upper layer, and wherein the upper layer comprises an upper headlap and an upper buttlap, and wherein the upper buttlap comprises two or more tabs interspersed with inter-tab spacings.

5. A roofing system according to claim 4, wherein the backing layer further comprises a low density aggregate that is selected from the group consisting of: perlite, polymeric expanded beads, microspheres, expanded graphite, granulated polymers, foamed glass, or combinations thereof.

6. A roofing system according to claim 4, wherein the layered shingle is lighter in weight than a corresponding shingle having substantially the same thickness except having a backer comprising sand and/or granule/rock fines.

7. A method for cladding a structure comprising a substrate, the method comprising:

securing a plurality of shingles to the substrate, wherein at least one of the shingles is a layered shingle comprising an upper layer comprising a substrate-facing surface, the upper layer selected from an asphalt layer, a lamination layer, and a paint layer; and a backing layer comprising between about 40% to about 90% by weight of expanded clay, wherein the backing layer is fixed to the substrate-facing surface of the upper layer, and wherein the upper layer comprises an upper headlap and an upper buttlap, and wherein the upper buttlap comprises two or more tabs interspersed with inter-tab spacings.

8. A method according to claim 7, wherein the backing layer further comprises a low density aggregate that is selected from the group consisting of: perlite, polymeric expanded beads, microspheres, expanded graphite, granulated polymers, foamed glass, or combinations thereof.

9. A method according to claim 7, wherein the layered shingle is lighter in weight than a corresponding shingle having substantially the same thickness except having a backer comprising sand and/or granule/rock fines.

* * * * *